US010962339B2

(12) United States Patent
Boulanger et al.

(10) Patent No.: US 10,962,339 B2
(45) Date of Patent: Mar. 30, 2021

(54) SHELL FOR AMMUNITION AND AMMUNITION INCLUDING SUCH A SHELL

(71) Applicant: NEXTER MUNITIONS, Versailles (FR)

(72) Inventors: Rémi Boulanger, Bourges (FR); Frédéric Nozeres, Bourges (FR)

(73) Assignee: NEXTER MUNITIONS, Versailles (FR)

( * ) Notice: Subject to any disclaimer, the term of this patent is extended or adjusted under 35 U.S.C. 154(b) by 0 days.

(21) Appl. No.: 16/587,449

(22) Filed: Sep. 30, 2019

(65) Prior Publication Data

US 2020/0103209 A1 Apr. 2, 2020

(30) Foreign Application Priority Data

Oct. 1, 2018 (FR) ..... 1801044

(51) Int. Cl.
*F42B 12/32* (2006.01)

(52) U.S. Cl.
CPC ..... *F42B 12/32* (2013.01)

(58) Field of Classification Search
CPC ..... F42B 12/32
USPC ..... 102/493, 495, 496
See application file for complete search history.

(56) References Cited

U.S. PATENT DOCUMENTS 3,757,693 A * 9/1973 Shea ..... B21D 31/02 102/493
5,313,890 A * 5/1994 Cuadros ..... F42B 12/32 102/393
6,857,372 B2 2/2005 Renaud-Bezot et al.
9,528,801 B1 * 12/2016 Gold ..... F42B 12/204
2008/0156220 A1 7/2008 Tanguy
2012/0192753 A1 * 8/2012 Scheid ..... F42B 12/32 102/495
2012/0192754 A1 8/2012 Scheid et al.
2016/0273898 A1 9/2016 Kravel

FOREIGN PATENT DOCUMENTS

EP 0545823 A1 6/1993
EP 0999425 A1 5/2000
FR 2812385 A1 2/2002
FR 2867849 A1 9/2005
FR 3038043 A1 12/2016

OTHER PUBLICATIONS

Jun. 21, 2019 Search Report and Written Opinion issued in French Patent Application No. 1801044.

* cited by examiner

*Primary Examiner* — Reginald S Tillman, Jr.
(74) *Attorney, Agent, or Firm* — Oliff PLC

(57) ABSTRACT

The invention relates to a shell (4) intended to be placed around a fragment-generating body (2) of an ammunition (1). This shell is characterized in that it comprises an inner wall (9) having a geometry such that it can be positioned with shape matching with that of the body (2) on which it is intended to be fastened, the inner wall (9) bearing cells (11) having a profile with a closed contour secured to the wall (9) by a first end, the cells (11) not being adjoining, therefore separate from one another, all the way around their contour by a non-nil distance (d).

Figure 1A:
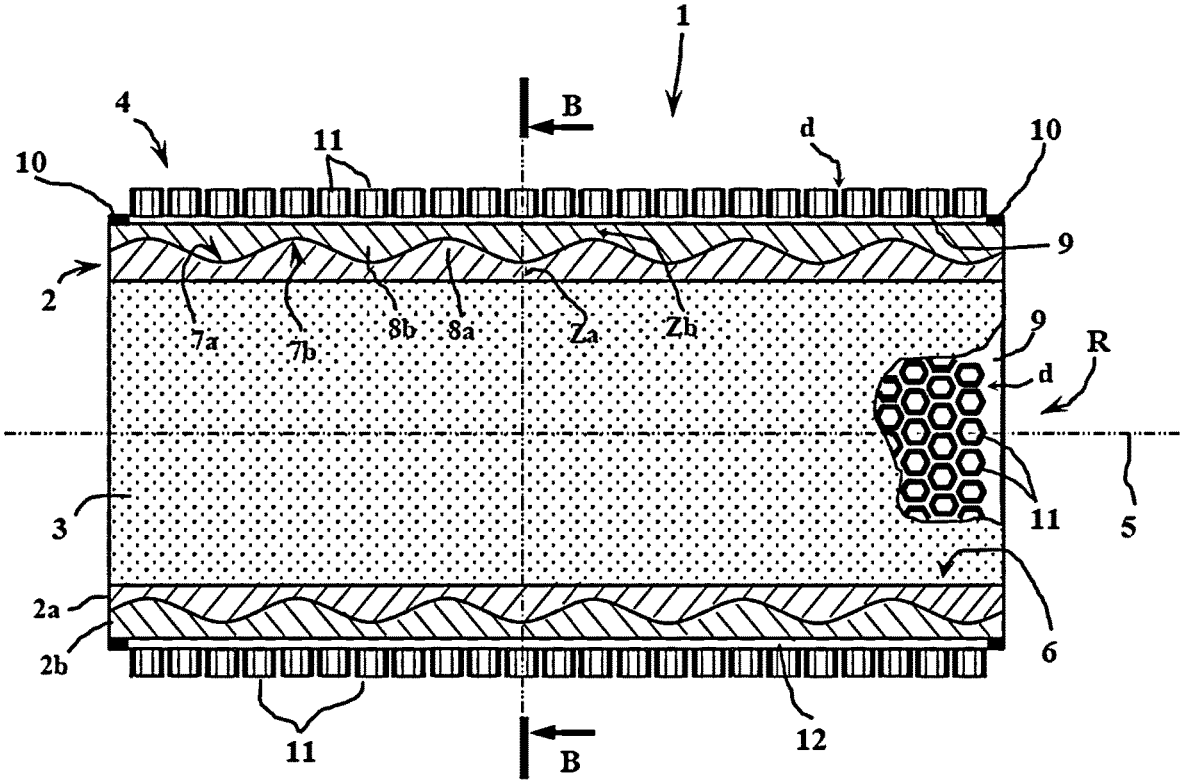

The invention also relates to an explosive ammunition including such a shell.

10 Claims, 3 Drawing Sheets

SHELL FOR AMMUNITION AND AMMUNITION INCLUDING SUCH A SHELL

The technical field of the invention is that of ammunitions, and more particularly shells intended to surround an ammunition body.

Known from patent FR 2,812,385 is a fragment-generating ammunition that includes a steel or tungsten body that is surrounded by a shell, for example made from a plastic material and that for example contains a metal grate making it possible to calibrate the fragments created by the body.

This shell is specifically designed to promote the formation of fragments, but it does not provide any protection of the ammunition with respect to received impacts.

An effort is made today to produce fragment-generating ammunitions having high performance levels, that is to say, containing an explosive having a detonation speed greater than or equal to 8000 meters per second. Such explosives allow the projection of dense fragments at a high speed, which increases their effectiveness with respect to hard targets.

Unfortunately, these high detonation performance levels are quite often combined, for these explosives, with a high sensitivity to impacts compared to compositions having a lower detonation speed. Yet efforts are currently being made to produce ammunitions with a lower vulnerability, and in particular able to meet the requirements of standard NATO STANAG 4439, which lists the vulnerability tests associated with the expected reaction levels.

The known deconfinement means for the ammunition body make it possible to ensure the resistance of the ammunition in intense thermal environments (such as the rapid heating and slow heating tests specified and referenced in STANAG 4439).

Conversely, these devices are of no use in the case of purely mechanical attacks such as fragment impacts, as specified by STANAG 4439 and by French Ministerial Instruction DGA IPE 211/893 dated Jul. 21, 2011.

In this case, it is the very structure of the ammunition that must contribute to lessening the energy transmitted to the load by the impact of the fragment. Yet the definition of this structure is dictated by the characteristics of its detonation operation, in particular the speed and the distribution of the fragments that will be created by the ammunition.

The addition of extra protection can only slow the projection of fragments and therefore disrupt the operation of the ammunition and alter its operational characteristics.

The conventional protections against mechanical attacks (fragment impacts within the meaning of STANAG 4439 and Ministerial Instruction DGA IPE 211/893) currently land on logistical packaging.

To date, the only protection for ammunitions after they leave the packaging and making it possible to meet the requirements of STANAG 4439 have been obtained by choosing an explosive with decreased sensitivity. However, such explosives do not have the desired detonation performance (detonation speed greater than or equal to 8000 meters per second).

Known from patent US2016/273898 is a hand grenade with a rubber shell, the body of which includes massive protuberances separated by slots forming defined fragmentation zones. The protuberances here form the nonlethal fragments created by this grenade. Such thick protuberance shapes cannot be combined with high-performance metal fragments.

It is the aim of the invention to propose a shell making it possible to protect an ammunition against received mechanical impacts without hindering the operation of the ammunition.

The invention also relates to an ammunition equipped with such a protective shell.

Thus, the invention relates to a shell intended to be placed around a fragment-generating body of an ammunition, the shell being characterized in that it comprises an inner wall having a geometry such that it can be positioned with shape matching that of the body on which it is intended to be fastened, the inner wall bearing cells, each cell having a profile with a closed contour secured to the wall by a first end and extending radially at a distance from the wall, the cells being regularly angularly and longitudinally distributed around the inner wall so as to form a network covering the entire shell, the cells not being adjoining, therefore separate from one another, all the way around their contour by a non-nil distance.

The cells may have a hexagonal shape or a cylindrical or prismatic shape.

According to one variant, the shell may include an outer protective wall, with a mechanical strength lower than that of the inner wall, the outer wall covering the network of cells.

Advantageously, the cells may be separated from one another by a distance substantially equal to the thickness of the cell.

The invention also relates to an explosive ammunition comprising a fragment-generating body containing an explosive charge, the ammunition being characterized in that the body is surrounded by such a shell.

Advantageously, the shell may be positioned at a distance from the body, the shell being secured to the body at least at two annular steps.

The distance separating the shell from the body may be between 0.01 mm and 1 mm.

According to one particular embodiment, the shell may be manufactured at the same time as the body using an additive manufacturing technology.

Figure 1B:
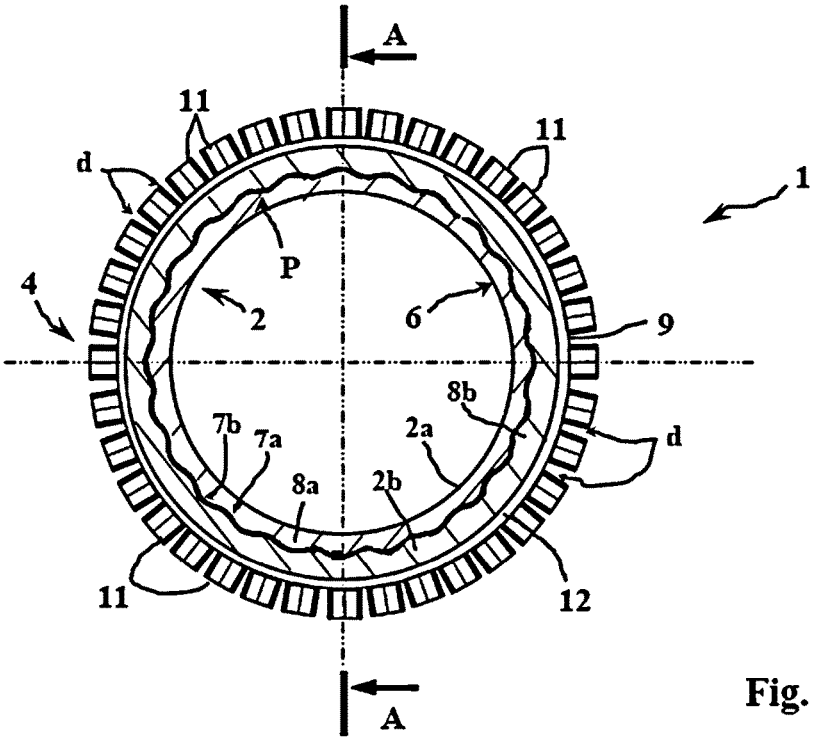

The invention will be better understood upon reading the following description of different embodiments, the description being done in reference to the appended drawings and in which:

FIG. 1*a* is a longitudinal sectional view of an explosive ammunition incorporating a shell according to one embodiment of the invention, the section being taken along the plane whose outline AA is identified in FIG. 1*b;*

FIG. 1*b* is a cross-sectional view of this explosive ammunition, the section being taken along the plane whose outline BB is identified in FIG. 1*a;*

Figure 2A:
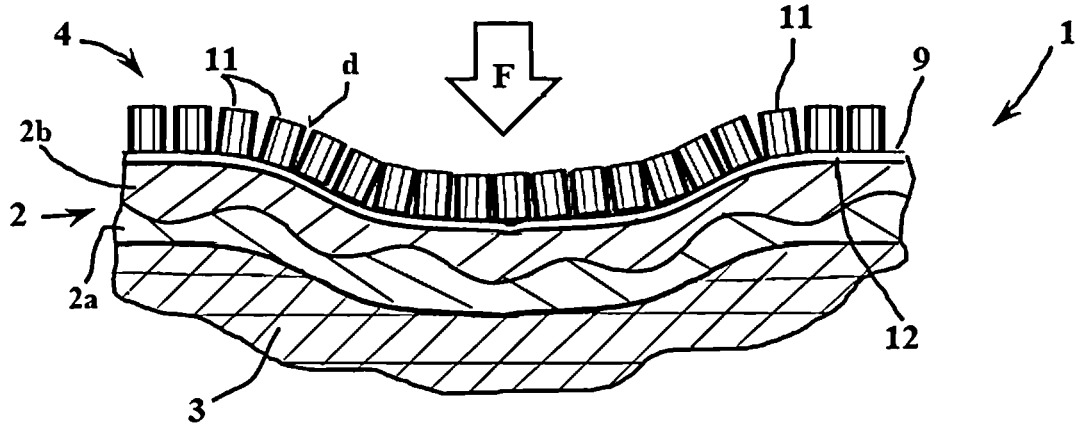
Figure 2B:
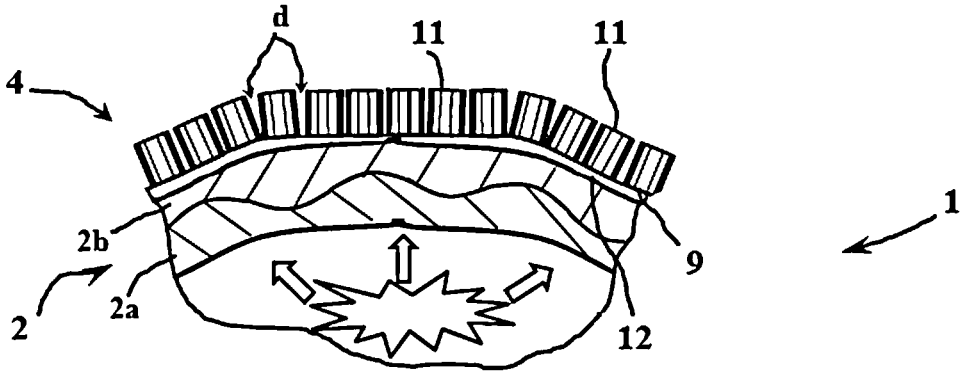
Figure 3A:
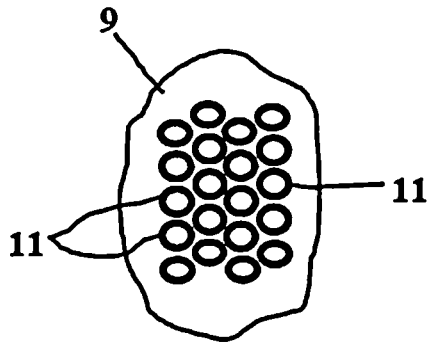
Figure 3B:
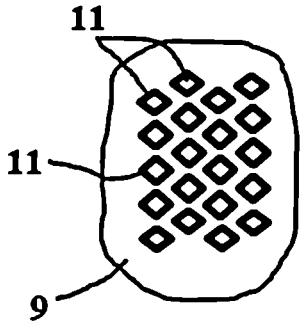
Figure 4:
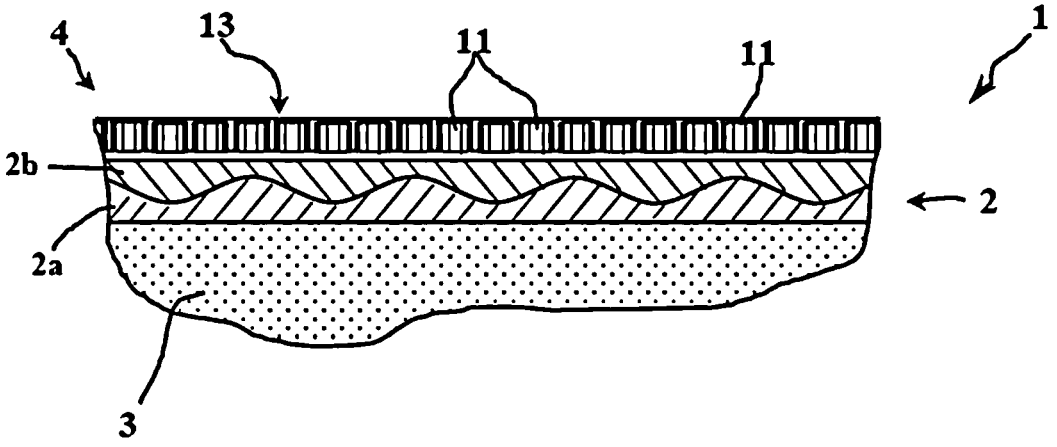

FIG. 2*a* schematically shows, in partial longitudinal sectional view, an ammunition according to the invention deformed by an impact;

FIG. 2*b* schematically shows this same ammunition during the detonation of the charge;

FIGS. 3*a* and 3*b* are schematic views of the outside of the shell according to embodiment variants of the invention;

FIG. 4 is a partial longitudinal sectional view of an explosive ammunition incorporating a shell according to another embodiment of the invention.

In reference to FIGS. 1*a* and 1*b*, an explosive ammunition 1 according to the invention comprises a fragment-generating body 2 that contains an explosive charge 3 and the body 2 is surrounded by a shell 4. The ammunition is for example a fragment-generating charge that is intended to form a warhead equipping a missile or a rocket. The ammunition could also be an explosive projectile or a bomb (with a body profile that is not cylindrical).

The fragment-generating body 2 is generally cylindrical and has an axis 5. It includes two walls 2*a* and 2*b*. A first wall 2*a* (or inner wall) comprises a cylindrical housing 6 that receives the explosive charge 3.

A second wall 2*b* (or outer wall) is coaxial to the first and is made from the same material as the first wall.

The first wall 2*a* and the second wall 2*b* each have, on their surfaces that are facing one another, alternating hollow shapes 7*a*, 7*b* and raised shapes 8*a* and 8*b*. Each hollow 7*a* of the first wall 2*a* is across from a boss 8*b* of the second wall 2*b*.

Similarly, each hollow 7*b* of the second wall 2*b* is across from a boss 8*a* of the first wall 2*a*.

As shown in FIGS. 1*a* and 1*b*, these alternating hollows and bosses are distributed, not only axially (FIG. 1*a*), but also angularly along the profile P separating the two walls (FIG. 1*b*).

Such a fragment-generating structure with a double shell is described in detail by patent application FR 3,038,043, and it is not necessary to further specify it.

The alternating hollows 7*a*, 7*b* and bosses 8*a*, 8*b* make it possible to form a mesh that embodies weak lines of the walls at the various zones Za and Zb that have the minimum thicknesses (zones in line with the bottoms of the hollows 7*a* and 7*b*)—see FIG. 1*a*.

The walls 2*a* and 2*b* are separated by a space (not visible in the figures), the thickness of which is around a tenth of a millimeter. This space makes it possible to promote the breaking of the walls 2*a* and 2*b* during the detonation of the explosive charge 3 contained by the body 2.

Such an architecture makes it possible to produce a relatively thick shell, providing the mechanical resistance to harsh firing environments, and reproducibly weakened by the mesh at the same time, which makes it possible to create calibrated fragments.

As described by patent application FR 3,038,043, the two walls 2*a* and 2*b*, which cannot be disassembled from one another due to the hollows and bosses, are made simultaneously, transverse layer by transverse layer, through an additive manufacturing method.

According to the invention, the body 2 of the ammunition 1 is surrounded by a shell 4.

This shell 4 comprises an inner wall 9 having a geometry such that it can be positioned with shape matching with that of the body 2 on which it is intended to be positioned. Here, the body 2 is cylindrical, the inner wall 9 is therefore also cylindrical. It would of course be possible to implement the invention with another ammunition body shape, for example in a warhead shape for a projectile or a bomb body.

According to the embodiment that is described here, the shell 4 is positioned at a distance from the body 2. There is therefore an annular space 12 between the body 2 and the shell 4. The distance is between 0.01 mm and 1 mm. Due to the cylindrical profile of the outside of the body 2, it is possible to fasten the shell 4 by a simple mechanical assembly (for example, threads at end steps).

Thus, according to FIG. 1*a*, the shell 4 is secured to the body 2 at least at two annular steps 10, one at each end of the body 2.

It is possible, depending on the length of the body 2, to provide other support steps for the shell 4, which may or may not be annular. It is in fact possible to replace an annular step with several maintaining studs distributed angularly and axially.

An effort will, however, be made to limit the number of steps 10 or studs, since they may hinder the operation of the ammunition 1 by disrupting fragment generation.

Advantageously, the shell 4 (the inner wall 9 and the cells 11 that it carries) will be manufactured at the same time as the body 2 using an additive manufacturing technology. Such an arrangement makes it possible to limit the support steps 10 of the shell 4 to the minimum volume.

As shown in FIGS. 1*a* and 1*b*, the inner wall 9 carries cells 11 that are fastened on it.

Each cell 11 has a profile with a closed contour that is secured to the inner wall 9 by a first end and that extends radially at a distance from the inner wall 9.

The cells 11 are regularly angularly and longitudinally distributed around the inner wall 9 so as to form a network of cells substantially covering the entire shell 4.

To facilitate the understanding of the invention, FIG. 1*a* shows a zone R of the ammunition 1 that is not cut and that shows the different cells 11 fastened to the inner wall 9.

According to the embodiment that is shown, each cell 11 has a hollow hexagonal shape.

It will be noted in the figures that the cells 11 are not adjoining. They are separated from one another all the way around their hexagonal contour by a non-nil distance d. This distance d is substantially equal to the thickness of the cell 11, namely from 0.2 mm to 1 mm (preferably 0.3 mm).

The cells 11 are made from the same material as the inner wall 9, for example steel with high mechanical characteristics.

The wall 9 bearing the cells 11 thus forms a sort of honeycomb structure, but the cells 11 of which are not adjoining. The strength of this structure is therefore lower than that of conventional honeycomb structures.

FIGS. 2*a* and 2*b* show the operation of the shell 4 according to the invention schematically.

FIG. 2*a* shows a shell 4 surrounding a body 2 of an explosive ammunition 1 and receiving a radial impact F. The impact F results in a local deformation of the shell 4 and the body 2. However, it will be noted that the impact leads to bringing the cells 11 closer to one another. The cells 11 thus become adjoining in line with the impact, which increases the strength of the shell 4 at that location.

The shell 4 according to the invention therefore makes it possible to improve the resistance of the ammunition to outside mechanical impacts (falls, firing of small caliber projectiles, etc.).

Conversely, FIG. 2*b* shows an explosive ammunition 1 at the beginning of detonation. The body 2 expands through the action of the detonation of the explosive 3. The shell 4 also expands and, due to the non-adjoining nature of the cells 11, the distance d between the cells 11 increases and does not disrupt the gaining of speed of the fragments created by the shell 2.

Thus, the shell 3 according to the invention has different deformation characteristics depending on the direction of the mechanical stress that it receives.

It resists bending (FIG. 2*a*) when the impact comes from the outside due to bringing the different cells 11 closer to another one, with the cells 11 becoming adjoining.

Conversely, it bends easily (FIG. 2*b*) when the impact comes from the inside due to the separation of the cells 11, which increases.

The shell 4 therefore does not disrupt the formation and gaining of speed of the fragments of the body 2. The disruptions due to the shell 4 are lessened even more given that the shell 4 is, for this embodiment, positioned at a distance from the body 2 (annular space 12).

The size of the fragments therefore remains identical to that of a body 2 not covered by such a shell 4.

If it is possible to place, by simple mechanical assembly on the body 2 of an ammunition 1, a shell 4 that has been manufactured separately, it will advantageously be possible to manufacture the shell 4 and the body 2 of the ammunition 1 through a single additive manufacturing operation. The shell 4 and the body 2 are then made from the same material (steel with high mechanical characteristics).

This technology will make it possible to provide the annular space 12 and will also produce the annular steps 10 (shared material zones between the body 2 and the shell 4).

It is of course possible to produce a shell 4 in which the cells 11 have a profile other than hexagonal.

As an example, FIG. 3*a* partially shows a network of cylindrical cells 11 and FIG. 3*b* shows a network of cells 11 with a square section (prism with square section). The cells could have other prismatic (parallelepiped) shapes.

FIG. 4 shows another embodiment that differs from the previous one by the presence of an outer wall 13 that covers the network of cells 11.

The sole function of this wall 13 is to provide protection for the ammunition, in particular against sludge that may become lodged in the cells 11. It will have a mechanical strength lower than that of the material of the shell 4 so as not to hinder the mechanisms previously described. It may in particular have a smaller thickness (much smaller than that of the inner wall 9).

The outer wall may be made in the form of a thin sheet of aluminum attached to the outside of the shell 4 after manufacturing of the latter.

The invention claimed is:

1. A shell intended for use with a fragment-generating body of an ammunition, the shell comprising:

an inner wall having a geometry and shape such that the shell can be placed around the fragment-generating body on which the shell is intended to be attached, and a plurality of hollow cells provided on the inner wall of the shell, each hollow cell having a profile with a closed contour secured to the inner wall by a first end and extending radially at a distance from the inner wall, the hollow cells being regularly angularly and longitudinally distributed around the inner wall so as to form a network of hollow cells substantially covering an entirety of the shell, wherein:

the hollow cells are not adjoining to each other, and a contour of each hollow cell is separate from each other by a non-zero distance.

2. The shell according to claim 1, wherein the hollow cells have a hexagonal shape.

3. The shell according to claim 1, wherein the hollow cells have a cylindrical shape.

4. The shell according to claim 1, wherein the shell includes a protective outer wall having a first mechanical strength that is less than a second mechanical strength of the inner wall, and the protective outer wall is configured to cover the network of hollow cells.

5. The shell according to claim 1, wherein the hollow cells are separated from one another by a distance substantially equal to a thickness of a respective hollow cell.

6. An explosive ammunition comprising:

a fragment-generating body containing an explosive charge, wherein the fragment-generating body is surrounded by the shell according to claim 1.

7. The explosive ammunition according to claim 6, wherein the shell is positioned at a distance from the fragment-generating body, and the shell is secured to the fragment-generating body by at least at two annular steps.

8. The explosive ammunition according to claim 7, wherein the distance separating the shell from the fragment-generating body is between 0.01 mm and 1 mm.

9. The explosive ammunition according to claim 6, wherein the shell is manufactured at the same time as the fragment-generating body based on an additive manufacturing technology.

10. The explosive ammunition according to claim 6, wherein the non-zero distance between the hollow cells is between 0.2 mm and 1 mm.

* * * * *